United States Patent [19]

Andrews

[11] 4,379,524

[45] Apr. 12, 1983

[54] FUEL INJECTION NOZZLES

[75] Inventor: Richard J. Andrews, Guildford, England

[73] Assignee: Lucas Industries Limited, Birmingham, England

[21] Appl. No.: 245,166

[22] Filed: Mar. 18, 1981

[30] Foreign Application Priority Data

May 16, 1980 [GB] United Kingdom ..... 8016231

[51] Int. Cl.[3] ..... F02M 61/20

[52] U.S. Cl. ..... 239/533.8; 239/584

[58] Field of Search ..... 239/533.2–533.11, 239/584

[56] References Cited

U.S. PATENT DOCUMENTS 4,261,513 4/1981 Andrews ..... 239/125 X

FOREIGN PATENT DOCUMENTS 1472401 5/1977 United Kingdom ..... 239/533.3

*Primary Examiner*—Andres Kashnikow

[57] ABSTRACT

A fuel injection nozzle includes a valve member which is biassed into contact with a seating to prevent fuel flow through an outlet, by means of a spring housed within a chamber. The chamber is in part defined by a surface against which fuel pressure can act to assist the action of the spring. The pressure in the chamber is derived from the fuel inlet of the nozzle by way of a valve the valve member of which can be urged onto its seating to prevent increase in the pressure in the chamber beyond a predetermined value, by the action of two pistons operating together as a differential piston.

5 Claims, 4 Drawing Figures

FUEL INJECTION NOZZLES

This invention relates to fuel injection nozzles of the kind comprising a fuel pressure operable valve member slidable within a bore, a seating located at one end of the bore, the valve member being shaped for co-operation with said seating to prevent fuel flow from an inlet to an outlet, resilient means for biassing the valve member into contact with the seating, a chamber, a valve through which fuel under pressure can flow to said chamber, a surface in said chamber, the fuel pressure acting on said surface creating a force which assists the action of said resilient means.

Two forms of such nozzles are shown in the specifications of British Pat. Nos. 1,412,413 and 1,472,401 respectively. In the nozzle shown in specification 1,412,413 the aforesaid surface is defined on a push member acting intermediate the spring and the valve member and the means for supplying fuel under pressure comprises a simple non-return valve. The opposite end of the push member is exposed to drain pressure as also is the adjacent end of the valve member. In the nozzle shown in specification 1,472,401, the aforesaid surface is defined on the valve member itself and a non-return valve is employed to admit fuel under pressure to the chamber. In this case however, the valve acts as a pressure regulator to control the pressure in the bore so that it is a proportion of the pressure at the fuel inlet.

In both the known forms of apparatus the pressure required to lift the valve member from its seating will rise as the peak pressure at the fuel inlet increases. This pressure is known in the art as the nozzle opening pressure. There is now a requirement that the nozzle opening pressure should rise to a maximum value part way through the speed range of the associated engine when the engine is operated at full fuel. It is required that the nozzle opening pressure should remain substantially constant as the engine speed continues to increase to its allowed maximum value.

It is therefore an object of the invention to provide a nozzle of the kind specified in a simple and convenient form in which this desideratum is obtained.

According to the invention a fuel injection nozzle of the kind specified is characterized in that the valve is located in a first passage connecting said inlet with said chamber, said valve including a valve member and a seating, the valve member being lifted from its seating by the fuel pressure at the inlet to allow fuel flow into said chamber, a first piston subject at one end to the pressure in said chamber, a second piston of larger diameter than the first piston, one end of said second piston being engaged with the other end of said first piston, a second passage through which the other end of said second piston is subject to the pressure in said chamber, resilient means opposing movement of the pistons under the action of the pressure in the chamber acting on the differential area of the pistons, said pistons being positioned so that when they move against the action of the resilient means, the valve member of said valve will be held upon its seating to prevent a further increase in the pressure of fuel in the chamber.

According to a further feature of the invention said second passage incorporates a non-return valve operable to prevent flow of fuel from the end of the cylinder containing the second piston to said chamber.

Two examples of fuel injection nozzle in accordance with the invention will now be described with reference to the accompanying drawings in which.

Figure 1:
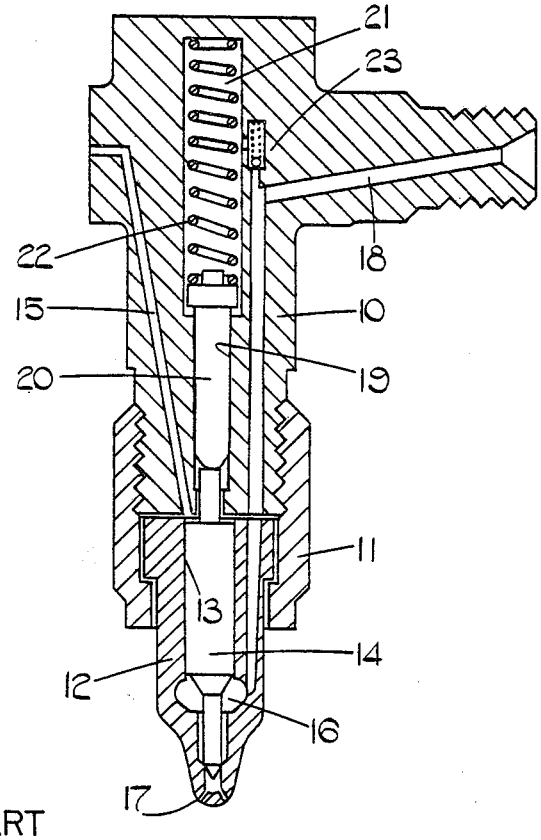
FIG. 1. PRIOR ART
FIG. 1 is a sectional side elevation of a known form of nozzle.
Figure 2:
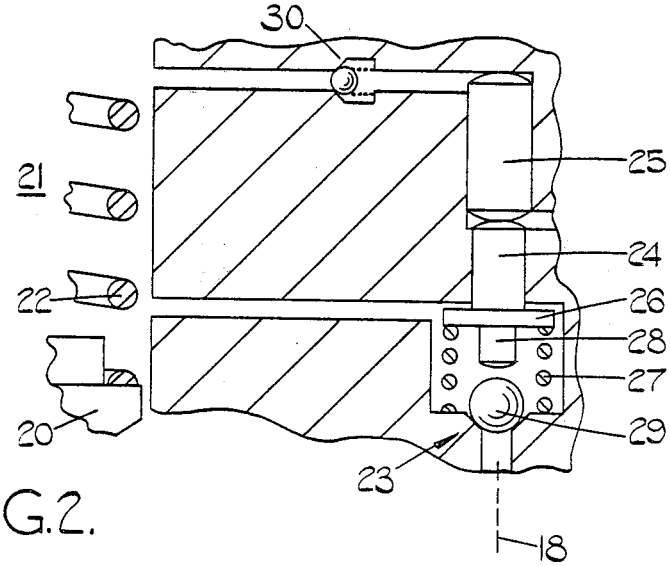
FIG. 2 is a diagrammatic view showing the modification necessary in accordance with the invention, to the nozzle shown in FIG. 1.

Referring to FIGS. 1 and 2 of the drawings, the fuel injection nozzle comprises a nozzle holder or body 10 to which is secured by means of a cap nut 11, a nozzle head 12. Formed in the nozzle head is a bore 13 in which is slidably mounted a valve member 14. The end of the bore adjacent the body communicates with a drain by way of a passage 15 extending within the body 10 and the other end of the bore terminates in an annular chamber 16 from which extends a reduced portion of the bore which is shaped to define a seating for engagement by a reduced portion of the valve member 14. Outlet orifices 17 extend from the narrower end of this portion of the bore. Fuel is supplied to the chamber 16 by way of a passage in the nozzle head 12 and the body 10 from a fuel inlet 18 which in use, is connected to a fuel injection pump which delivers fuel in timed relationship to the associated engine.

Formed in the body 10 is a further bore 19 in which is mounted a slidable push member 20 which engages with an extended portion of the valve member 14. The bore 19 extends into a chamber 21 which accommodates a coiled compression spring 22 which engages the push member to bias the push member and also the valve member 14 so that the latter contacts the seating. A non-return valve 23 allows fuel to flow from the inlet into the chamber 21. The area of the push member which is exposed to the pressure in the chamber is arranged to be less than the area of the valve member 14 which is exposed in use to the pressure of fuel at the inlet. This form of nozzle is described in the specification of British Pat. No. 1,412,413 and in operation, fuel under pressure from the inlet acts upon the valve member to lift same against the action of spring 22 and also against the action of the fuel pressure in the chamber 21 acting on the push member. The pressure in the chamber 21 in use, rises to the peak value of the output pressure of the fuel injection pump and this peak value of pressure is retained by the action of the valve 23. Leakage will of course occur so that when the pressure of fuel delivered by the pump decreases, the pressure in the chamber 21 can also decrease. As previously stated however the nozzle opening pressure will continue to increase as the pressure of fuel delivered by the fuel pump increases.

Turning now to FIG. 2 the valve 23 is retained but in this case it is not spring loaded to the closed position although a light spring could be provided for this purpose. Additionally provided is a pair of pistons 24, 25 which are located in axially disposed cylinders. The first piston 24 is of slightly smaller diameter than the piston 25 and is provided with a flange 26 which is engaged by a coiled compression spring 27 and in addition, this piston has a projection 28 positioned to engage the valve member in this case a ball 29, of the valve 23. The adjacent faces of the two pistons are crowned and the space thus formed communicates with a drain. The other end of the cylinder containing the second piston 25, is connected by way of a passage to the chamber 21. This passage incorporates a spring loaded non-return valve 30 which is disposed to permit fuel flow from the chamber 21 to the end of the cylinder containing the piston 25.

The piston 24 is subject to the pressure of fuel in the chamber but since the two pistons have a different diameter, the fuel under pressure in the chamber 21 acting upon the differential area of the pistons, will produce a force opposing the action of the spring 27. In use, as the fuel pressure in the chamber 21 increases, a value of pressure will be attained at which the two pistons start to move against the action of the spring 27 and such movement can act to close or hold the ball 29 on to its seating thereby preventing further flow of fuel into the chamber 21. The pressure of fuel in the chamber therefore is held substantially constant even though the pressure of fuel at the inlet may continued to increase.

Leakage of fuel will of course occur from the chamber 21 and also along the working clearance defined between the pistons 24 and 25 and their respective cylinders. Some leakage is of course necessary so that when the fuel pressure at the inlet 18 falls the pressure in the chamber 21 can also fall. When the pressure of fuel at the inlet 18 is high then the leakage from the chamber 21 and also the leakage along the aforesaid working clearances, is made up by the fact that the pistons 24 and 25 will move away from the ball by a slight amount to permit restoration of the pressure.

Figure 3:
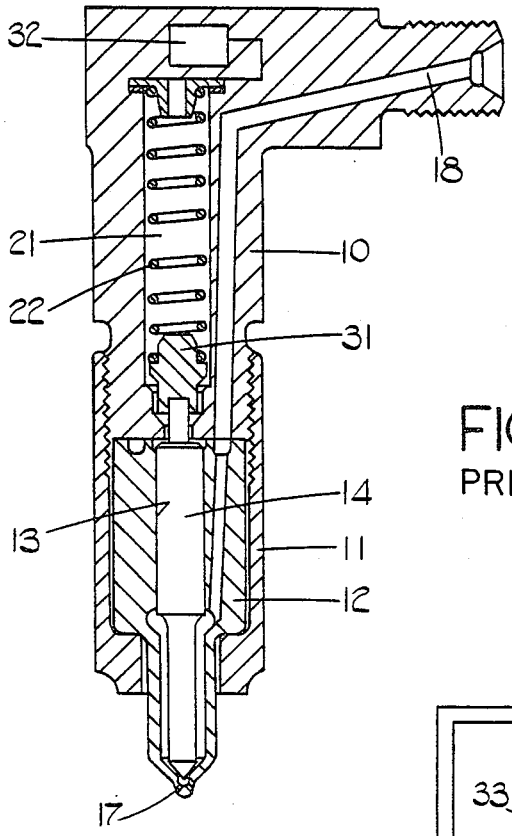
FIG.3. PRIOR ART
FIG. 3 is a part sectional side elevation of another form of injection nozzle.

Turning now to FIG. 3, the parts of the nozzle which have the same function have been assigned the same reference numerals as those in FIG. 1.

In the injection nozzle shown in FIG. 3, the spring 22 acts directly upon the valve member 14, an abutment 31 being carried by the extension of the valve member 14. Moreover, the end of the valve member is not as in the example of FIG. 1, exposed to drain pressure but rather to the pressure within the chamber 21. A valve means 32 is illustrated for passing fuel from the inlet 18 into the chamber 21. The fuel pressure in the chamber 21 must however be less than the pressure in the chamber 21 of the example of FIG. 1 because the fuel pressure in the chamber 21 is acting in opposition to the fuel pressure acting to effect movement of the valve member 14 way from its seating. The nozzle shown in FIG. 3 is described in the specification of British Pat. No. 1,472,401 and the valve means 32 comprises a regulating valve. In modifying the nozzle of FIG. 3, the components shown in FIG. 4 replace the valve means 32 and where possible, they have been assigned the same reference numerals as those in FIG. 2. The only significant difference is the form of the valve indicated at 33, which permits fuel flow from the inlet 18 to the chamber. In the example shown in FIG. 4 the valve member comprises a stem 34 slidable within a bore and connected to the stem is a valve head 35 which can co-operate with a seating. The effective area of the valve member which is exposed to the pressure at the inlet 18 is less than that which is exposed to the pressure in the chamber and hence both after the valve is closed and before the valve is closed the pressure in the chamber will be less than that at the inlet. A spring is illustrated to bias the head into contact with the seating but this is an optional feature.

Figure 4:
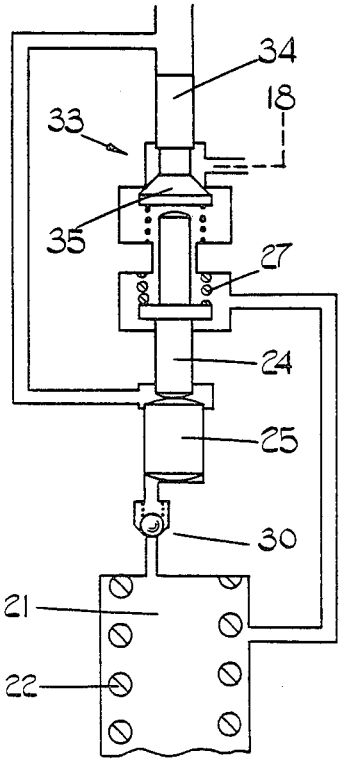
FIG. 4 is a diagrammatic view showing the modification necessary to the nozzle of FIG. 3.

The mode of operation of the arrangement shown in FIG. 4 is exactly the same as that shown in FIG. 2 the difference being of course that by virtue of the aforesaid differential areas of the valve, the resultant pressure in the chamber 21 is lower.

The non-return valves 30 in both examples act to lock off the pressure applied to the piston 25 so that once the valve members 29 and 33 have been urged onto their seatings by the action of the pistons then increases in the pressure at the inlets 18 will not unseat the valves.

I claim:

1. A fuel injection nozzle comprising a fuel pressure operable valve member slidable within a bore, a seating at one end of the bore, the valve member being shaped for co-operaton with said seating to prevent fuel flow from an inlet to an outlet, resilient means for biassing the valve member into contact with the seating, a chamber, a valve through which fuel under pressure can flow to said chamber, a surface in said chamber, the fuel pressure acting on said surface creating a force which assists the action of said resilient means characterized in that the valve is located in a first passage connecting said inlet with said chamber, said valve including a valve element and a valve seating, the valve element being lifted from the valve seating by the fuel pressure at the inlet to allow fuel flow into said chamber, a first piston subject at one end to the pressure in said chamber, a second piston of larger diameter than the first piston, one end of said second piston being engaged with the other end of said first piston, a second passage through which the other end of said second piston is subject to the pressure in said chamber, resilient means opposing movement of the pistons under the action of the pressure in the chamber acting on the differential area of the pistons, said pistons being positioned so that when they move against the action of the resilient means, the valve element of said valve will be held upon the valve seating to prevent a further increase in the pressure of fuel in the chamber.

2. A nozzle according to claim 1 in which the second passage incorporate a non-return valve operable to prevent flow of fuel from the end of the cylinder containing the second piston to said chamber.

3. A nozzle according to claim 1 or claim 2 in which the valve element of said valve comprises a ball.

4. A nozzle according to claim 1 or claim 2 in which the valve is a differential valve having an area exposed to the pressure in the chamber which is greater than the area exposed to the pressure at the inlet whereby both before and after the valve is closed by the action of said pistons, the pressure in said chamber will be less than the pressure at the inlet.

5. A nozzle according to claim 4 in which said valve includes a stem slidable in a bore, a head mounted on said stem for co-operation with the valve seating, the end of said stem remote from said head being exposed to drain pressure, and the end surface of said head being exposed to the pressure in said chamber, the annular area defined by the underside of said head being exposed to the pressure at said inlet.

* * * * *